US011844390B2

(12) United States Patent
Chilson et al.

(10) Patent No.: US 11,844,390 B2
(45) Date of Patent: Dec. 19, 2023

(54) HELMET WITH SHOCK ABSORBING INSERTS

(71) Applicant: Smith Sport Optics, Inc., Portland, OR (US)

(72) Inventors: James A. Chilson, Halley, ID (US); John Lloyd, Monte Carlo (MC); James Rogers, Carlisle (GB); Piers Storey, Nice (FR)

(73) Assignees: Smith Sport Optics, Inc., Portland, OR (US); Koroyd SARL, Monaco (MC)

( * ) Notice: Subject to any disclaimer, the term of this patent is extended or adjusted under 35 U.S.C. 154(b) by 524 days.

(21) Appl. No.: 16/989,695

(22) Filed: Aug. 10, 2020

(65) Prior Publication Data

US 2020/0367596 A1 Nov. 26, 2020

Related U.S. Application Data

(63) Continuation of application No. 13/965,703, filed on Aug. 13, 2013, now Pat. No. 10,736,373.

(51) Int. Cl.
*A42B 3/28* (2006.01)
*A42B 3/12* (2006.01)

(52) U.S. Cl.
CPC ..... *A42B 3/28* (2013.01); *A42B 3/124* (2013.01); *A42B 3/127* (2013.01); *A42B 3/281* (2013.01); *Y10T 29/53996* (2015.01)

(58) Field of Classification Search
CPC ..... A42B 3/127; A42B 3/28; A42B 3/281
See application file for complete search history.

(56) References Cited

U.S. PATENT DOCUMENTS

| | | | | |
|---|---|---|---|---|
| 3,055,012 A | | 9/1962 | Aileo | |
| 3,239,842 A | | 3/1966 | Marchello | |
| D213,085 S | | 1/1969 | Wyckoff | |
| 3,447,163 A | * | 6/1969 | Tojeiro | A42B 3/065 428/116 |
| 3,500,475 A | | 3/1970 | Otsuka | |
| 3,720,955 A | | 3/1973 | Rawlings | |
| 3,946,441 A | * | 3/1976 | Johnson | A42B 3/063 2/412 |
| 4,006,496 A | * | 2/1977 | Marker | A42B 3/128 2/414 |

(Continued)

FOREIGN PATENT DOCUMENTS

| | | |
|---|---|---|
| CA | 2858707 C | 3/2017 |
| DE | 4336468 A1 | 4/1995 |

(Continued)

OTHER PUBLICATIONS

First Office Action dated Jun. 22, 2015 received for CA Appln No. 2,858,707.

(Continued)

*Primary Examiner* — Katherine M Moran
(74) *Attorney, Agent, or Firm* — Dorsey & Whitney LLP

(57) ABSTRACT

Helmets and methods for manufacturing a helmet are described. An example helmet includes a shell and a shock absorbing liner attached to the shell. The shock absorbing liner includes a cavity. The helmet a shock absorbing insert formed of a material different than the material of the shock absorbing liner. The cavity is configured to retain the shock absorbing insert.

21 Claims, 6 Drawing Sheets

(56) References Cited

U.S. PATENT DOCUMENTS 4,075,717 A 2/1978 Lemelson
4,307,471 A 12/1981 Lovell
D266,626 S 10/1982 Gooding
4,422,183 A 12/1983 Landi et al.
4,434,514 A 3/1984 Sundahl
4,484,364 A * 11/1984 Mitchell ..... A42B 3/124 2/909
D277,425 S 2/1985 Higginson
D300,275 S 3/1989 Sjogren et al.
4,916,759 A 4/1990 Arai
4,985,931 A 1/1991 Wingo
5,077,839 A 1/1992 Keller
5,083,321 A 1/1992 Davidsson
5,088,129 A 2/1992 Kamata
D340,318 S 10/1993 McCloud
D340,544 S 10/1993 Kamata
D354,376 S 1/1995 Kun
5,450,625 A * 9/1995 Hu ..... A63B 71/1225 2/22
D370,308 S 5/1996 Nilsson
5,561,866 A 10/1996 Ross
5,687,426 A 11/1997 Sperber
5,694,649 A 12/1997 Hefling et al.
5,701,610 A 12/1997 Hsu
5,840,397 A * 11/1998 Landi ..... B32B 27/08 428/116
5,867,840 A * 2/1999 Hirosawa ..... A42B 3/281 2/425
5,898,950 A 5/1999 Spyrou et al.
5,915,537 A 6/1999 Dallas et al.
D414,585 S 9/1999 Ho
5,950,244 A * 9/1999 Fournier ..... A42B 3/128 2/425
D415,593 S 10/1999 Tang
D424,246 S 5/2000 Ho
D426,032 S 5/2000 Ho
6,065,158 A 5/2000 Rush
6,073,272 A 6/2000 Ball
D428,534 S 7/2000 Ho
D437,092 S 1/2001 Ho
6,185,753 B1 2/2001 Arai
D444,268 S 6/2001 Montello
D445,219 S 7/2001 Ho
D445,545 S 7/2001 Ho
D447,288 S 8/2001 Ho
D447,604 S 9/2001 Watters et al.
6,282,724 B1 9/2001 Abraham et al.
D449,135 S 10/2001 Martin et al.
D449,713 S 10/2001 Martin et al.
D452,941 S 1/2002 Ho
D452,942 S 1/2002 Ho
D453,056 S 1/2002 Garneau
6,336,220 B1 1/2002 Sacks et al.
D453,975 S 2/2002 Ho
D455,522 S 4/2002 Royes et al.
6,387,200 B1 5/2002 Ashmead et al.
6,446,271 B1 9/2002 Ho
D464,174 S 10/2002 Lu
D464,468 S 10/2002 Ho
D476,776 S 7/2003 Finquel
D481,171 S 10/2003 Ho
D481,172 S 10/2003 Ho
D481,494 S 10/2003 Ho
D482,500 S 11/2003 Ho
D490,572 S 5/2004 Finquel
D495,093 S 8/2004 Tintera
D497,040 S 10/2004 Strauss
6,854,133 B2 2/2005 Lee et al.
D504,543 S 4/2005 Strauss
6,883,181 B2 4/2005 Long
D508,150 S 8/2005 Martin
6,970,691 B2 11/2005 Thompson
D517,739 S 3/2006 Ho
D518,241 S 3/2006 Finquel
7,089,602 B2 8/2006 Talluri
D530,043 S 10/2006 Foote et al.
D532,161 S 11/2006 Finquel
D535,059 S 1/2007 Lam
D541,480 S 4/2007 Turner
7,207,071 B2 4/2007 Pierce
D547,908 S 7/2007 Wise et al.
D549,394 S 8/2007 Broeckl
7,254,843 B2 8/2007 Talluri
D556,951 S 12/2007 Gath
D559,468 S 1/2008 Broecki
D563,053 S 2/2008 Fang
D563,054 S 2/2008 Fang
D563,055 S 2/2008 Fang
D565,249 S 3/2008 Fang
D570,548 S 6/2008 Ashida
D572,865 S 7/2008 Baker
D577,458 S 9/2008 Chan et al.
D608,504 S 1/2010 Baker
7,669,378 B2 3/2010 Tsunoda et al.
7,673,351 B2 3/2010 Copeland et al.
7,716,754 B1 5/2010 Ross
D628,346 S 11/2010 Petzl
7,828,759 B2 11/2010 Arensdorf
D628,749 S 12/2010 Daniel
D640,418 S 6/2011 Petzl
7,975,320 B2 7/2011 Muskovitz et al.
D645,210 S 9/2011 Chilson et al.
D650,132 S 12/2011 Chilson et al.
D650,949 S 12/2011 Richard
D650,950 S 12/2011 Richard
8,069,498 B2 12/2011 Maddux et al.
8,082,599 B2 12/2011 Sajic
8,087,101 B2 1/2012 Ferguson
D654,628 S 2/2012 Aris et al.
D655,048 S 2/2012 Moeller et al.
8,166,574 B2 5/2012 Hassler
D669,225 S 10/2012 Woxing et al.
D671,272 S 11/2012 Clement
D672,095 S 12/2012 Clement
D677,006 S 2/2013 Pfanner et al.
D679,865 S 4/2013 Garneau et al.
D683,904 S 6/2013 Ho
D683,905 S 6/2013 Wills
8,512,843 B2 8/2013 Villata
8,533,869 B1 9/2013 Capuano
D691,329 S 10/2013 Anderson
D699,896 S 2/2014 Ho
D700,746 S 3/2014 Capozzi et al.
8,667,618 B2 3/2014 Pierini et al.
D703,386 S 4/2014 Damin
8,707,470 B1 * 4/2014 Novicky ..... A42B 3/06 267/152
8,732,869 B2 5/2014 Onrot et al.
8,776,272 B1 7/2014 Straus et al.
D724,788 S 3/2015 Woxing et al.
8,966,669 B2 3/2015 Hines
8,986,798 B2 3/2015 Anderson et al.
D733,972 S 7/2015 Szalkowski et al.
D744,170 S 11/2015 Eastwood et al.
D745,744 S 12/2015 Saam
D752,294 S 3/2016 Chilson et al.
D752,814 S 3/2016 Chilson et al.
D759,899 S 6/2016 Finiel
D764,115 S 8/2016 Ashida
D771,874 S 11/2016 Chilson et al.
D773,120 S 11/2016 Chilson et al.
D773,739 S 12/2016 Yoo et al.
D776,357 S 1/2017 Marting et al.
D779,126 S 2/2017 Uhm
D795,500 S 8/2017 Chilson et al.
D817,553 S 5/2018 Aaskov et al.
9,986,779 B2 6/2018 Pritz et al.
D822,905 S 7/2018 Thorsell et al.
10,736,373 B2 * 8/2020 Chilson ..... A42B 3/124
10,834,987 B1 11/2020 Bottlang et al.
2001/0032351 A1 10/2001 Nakayama et al.
2002/0023290 A1 2/2002 Watters et al.
2002/0124298 A1 9/2002 Charles et al.

(56) References Cited

U.S. PATENT DOCUMENTS

| | | | | |
|---|---|---|---|---|
| 2004/0064873 | A1 | 4/2004 | Muskovitz | |
| 2004/0250339 | A1 | 12/2004 | Musal | |
| 2004/0261157 | A1* | 12/2004 | Talluri | A42B 3/069 2/412 |
| 2005/0015855 | A1 | 1/2005 | Skiba | |
| 2005/0060793 | A1 | 3/2005 | Rosie | |
| 2005/0283885 | A1 | 12/2005 | Stroud et al. | |
| 2006/0059605 | A1 | 3/2006 | Ferrara | |
| 2006/0059606 | A1 | 3/2006 | Ferrara | |
| 2006/0070171 | A1 | 4/2006 | Copeland et al. | |
| 2006/0096011 | A1 | 5/2006 | Dennis et al. | |
| 2006/0101556 | A1 | 5/2006 | Goldsborough | |
| 2006/0260026 | A1 | 11/2006 | Doria et al. | |
| 2007/0000025 | A1 | 1/2007 | Picotte | |
| 2007/0083965 | A1 | 4/2007 | Darnell et al. | |
| 2007/0130672 | A1 | 6/2007 | Beddoe et al. | |
| 2007/0136932 | A1 | 6/2007 | Muskovitz et al. | |
| 2008/0052808 | A1 | 3/2008 | Leick et al. | |
| 2008/0184463 | A1 | 8/2008 | Sawabe | |
| 2008/0295228 | A1 | 12/2008 | Muskovitz | |
| 2008/0307568 | A1 | 12/2008 | Sajic | |
| 2009/0049586 | A1 | 2/2009 | Wirthenstaetter | |
| 2009/0055999 | A1 | 3/2009 | Garcia | |
| 2009/0158506 | A1 | 6/2009 | Thompson | |
| 2009/0264073 | A1 | 10/2009 | Kushnirov | |
| 2010/0258988 | A1* | 10/2010 | Darnell | F16F 3/0876 267/141 |
| 2011/0252544 | A1 | 10/2011 | Abernethy | |
| 2012/0036619 | A1 | 2/2012 | Ytterborn et al. | |
| 2012/0036620 | A1 | 2/2012 | Harris | |
| 2012/0054947 | A1* | 3/2012 | Durocher | A42B 3/085 2/414 |
| 2012/0060251 | A1 | 3/2012 | Schimpf | |
| 2012/0151663 | A1* | 6/2012 | Rumbaugh | A42B 3/065 2/410 |
| 2012/0198604 | A1 | 8/2012 | Weber et al. | |
| 2013/0007950 | A1 | 1/2013 | Arai | |
| 2013/0061375 | A1 | 3/2013 | Bologna et al. | |
| 2013/0174329 | A1 | 7/2013 | Hanson et al. | |
| 2014/0013492 | A1 | 1/2014 | Bottlang et al. | |
| 2014/0250571 | A1 | 9/2014 | Pippillion et al. | |
| 2014/0338104 | A1 | 11/2014 | Vito et al. | |
| 2014/0366252 | A1 | 12/2014 | Mazzarolo et al. | |
| 2015/0047110 | A1 | 2/2015 | Chilson | |
| 2015/0047113 | A1 | 2/2015 | Stringfellow et al. | |
| 2015/0082520 | A1 | 3/2015 | Cheng et al. | |
| 2015/0305430 | A1* | 10/2015 | Rush | A42B 3/125 2/412 |
| 2016/0249702 | A1* | 9/2016 | Pfanner | A42B 3/125 2/416 |

FOREIGN PATENT DOCUMENTS

| | | | |
|---|---|---|---|
| EP | 2389822 | A1 | 11/2011 |
| WO | 2005060778 | A2 | 7/2005 |
| WO | 2008085108 | A1 | 7/2008 |

OTHER PUBLICATIONS

Examiner's Report for Canada Patent Appl. No. 2858707 dated Mar. 9, 2016.

"Fox Racing Striker Helmet", Fox MTB 2011 Collection, Fox Head Inc., 2010, 1-56.

U.S. Appl. No. 17/714,864 titled "Helmet With Shock Absorbing Inserts" filed Apr. 6, 2022.

"48-2 Proposed 2nd Declaration of Steve Copeland", In the United States District Court for the District of Colorado; Civil Action No. 1:21-cv-2112-CMA-SKC, Oct. 11, 2021.

"Bottlang Declaration PI Hearing", In the United States District Court for the District of Colorado; Civil Action No. 1:21-cv-2112-CMA-SKC, Sep. 15, 2021.

"Burton's Invalidity Contentions with Exhibits A-E", In the United States District Court for the District of Colorado; Civil Action No. 1:21-cv-2112-CMA-SKC, Jan. 26, 2022, 148 pages.

"Copeland_Declaration_PI_Hearing", In the United States District Court for the District of Colorado; Civil Action No. 1:21-cv-2112-CMA-SKC, Sep. 15, 2021.

"Fox MTB 2011 Collection", Burton catalog, 56 pages.

"Fox Striker helmet", by Bikemagic; https://bikemagic.com/accessories/fox-striker-helmet.html, Aug. 24, 2010, 2 pages.

"Fox Striker helmet", Mountain Biking Australia magazine; By Steve Hincliffe; https://www.mtbiking.com.au/gear/fox-striker-helmet, Jun. 22, 2012, 3 pages.

"IPR Petition Ex. 1003—Copeland Declaration", United States Patent and Trademark Office; Before the Patent Trial and Appeal Board; U.S. Pat. No. 10,736,373, Dec. 21, 2021.

"IPR Petition Ex. 1015—Fox MTB 2011 Catalog Part.2", Burton Exhibit 1015, Part. 2, Dec. 21, 2021, 26 pages.

"IPR Petition Ex. 1015—Fox MTB 2011 Catalog Part1", Burton Exhibit 1015 Part 1, Dec. 21, 2021, 30 pages.

"IPR Petition Ex. 1021—D.I. #022 Smith's Motion for Preliminary Injunction", Dec. 21, 2021, 31 pages.

"IPR Petition Ex. 1022—D.I. #046 Smith's Reply in Support of [D.I. #022] Motion for Preliminary Injunction", Dec. 21, 2021, 21 pages.

"IPR Petition Ex. 1023—D.I. #038 Brief in Opposition to [22] Motion for Preliminary Injunction filed by Burton", Dec. 21, 2021, 33 pages.

"IPR Petition Ex. 1024—D.I. #049 Smith's Opposition to Burton's Sur- Reply in Opposition to D.I. #022 Motion for Preliminary Injunction", Dec. 21, 2021, 14 pages.

"IPR Petition Ex. 1027—D.I. #001 Complaint", Dec. 21, 2021, 21 pages.

"Kirt Voreis Introduces New Fox Striker Helmet", Pink Bike by Karl Burkat; https://www.pinkbike.com/news/Kirt-Voreis-Instoduces-New-Fox-Striker-Helmet.html, Apr. 29, 2011, 3 pages.

"Koroyd", Facebook: https://www.facebook.com/koroydcore/photos/a.378732242242453/378732292242448, Apr. 17, 2013.

"Koroyd—with PROTOS Integral", Facebook: https://www.facebook.com/koroydcore/photos/a.378732242242453/378732305575780, Apr. 17, 2013, 2 pages.

"messevideofilm.de PROTOS Integral bauma 2013—You Tube", Messevideofilm: https://www.youtube.com/watch?v=5rSuNEA7oBs, Aug. 5, 2013, 5 pages.

"On the Snow website", https://www.onthesnow.com/, pp. 1-6.

"Petition for Inter Partes Review for U.S. Pat. No. 10,736,373", United States Patent and Trademark Office; Before the Patent Trial and Appeal Board; Petition for Inter Partes Review Under 35 U.S.C. §§ 311-319 AND 37 C.F.R. § 42.1 et seq, Dec. 21, 2021, 97 pages.

"Protos Integral Helmet Featuring Koroyd", Vimeo.com https://vimeo.com/63892011, Last accessed Aug. 17, 2021, 2013, pp. 1-2.

"Wakeling Declaration PI Hearing", In the United States District Court for the District of Colorado; Civil Action No. 1:21-cv-2112-CMA-SKC, Sep. 15, 2021.

Caserta, Gaetano et al., "Shock Absorption Performance of a Motorbike Helmet with Honeycomb Reinforced Liner", Composite Structures, 2011, pp. 93; pp. 2748-2759.

Caserta, Gaetano , "The Use of Honeycomb in the Design of Innovative Helmets", Imperial College of London, 2012, pp. 1-223.

Krogh, Ryan , "The 6 Best Ski and Snowboard Helmets of 2013", https://www.outsideonline.com/outdoor-gear/snow-sports-gear/bolle-synergy-helmet/, Oct. 31, 2012,.

Masia, Seth , "Ski Helmets: How We Got Here", International Skiing Association https://www.skiinghistory.org/history/ski-helmets-how-we-got-here, pp. 1-8.

Onori, Jason , "Best Snowboard and Ski Helmets for Big Heads | Which Helmet Should I Buy for a Large Head?", Active Life Store: The Blog http://www.activelifestore.com/blog/best-snowboard-and-ski-helmets-for- big-heads-which-helmet-should-i-buy-for-a-large-head/, Feb. 4, 2014, pp. 1-12

"Burton-0046216", https:/ / issuu.com/freeskiermagazine/ docs/freeskier-february-2013, captured Jun. 20, 2023.

"Burton-0046221", https://www.youtube.com/watch?v=-XGbLLxNoqS, captured Jun. 20, 2023.

(56) References Cited

OTHER PUBLICATIONS

"Burton-0046223", Youtube. POC features Skull Comp 2.0 [Video, at 0.05], accessed on Jun. 22, 2023: https://www.youtube.com/watch?v=-XGbLLxNoq8.
"Burton-0046224", https://www.youtube.com/watch?v=FMOveFgADec, captured Jun. 20, 2023.
"Burton-0046226", Youtube, POC Skull Comp 2.0 [Video, at 1.29], accessed on Jun. 22, 2023: https://www.youtube.com/watch?v=FMOveFgADec.
"Burton-0046227", https://www.youtube.com/watch?v=4ad3WgyL6ro, captured Jun. 20, 2023.
"Burton-0046229", Youtube. Pret Shaman Helmet [Video, 44 sec.], accessed on Jun. 22, 2023: https://www.youtube.com/watch?v=4ad3WgyL6ro.
"Burton-0046345", https:/ /www.youtube.com/watch?v=hFC2UOv5Dn4, captured Jun. 20, 2023.
"Burton-0046174", Facebook: https:/ /www.facebook.com/photo/?fbid=418341914914227&set=a.182988238449597, captured Jun. 20, 2023.
"Burton-0046211", https:/ /issuu.com/freeskiermagazine/ docs/v15freeskier_buyersguide, captured Jun. 20, 2023.
"Burton's First Amended Invalidity Contentions", In the United States District Court for the District of Colorado: Civil Action No. 1:21-cv-2112-CMA-SKC, 476 pages.
"Plaintiffs' Response to Defendant's First Amended Invalidity Contentions", In the United States District Court for the District of Colorado: Case No. 1:21-cv-02112-CMA-SKC, 206 pages.
"Skull Comp 2.0 Orange White XLarge-XXLarge 59/60-61/62 Poc Sports Helmet—Used", www.ebay.com, last accessed Jul. 3, 2023.

* cited by examiner

HELMET WITH SHOCK ABSORBING INSERTS

CROSS-REFERENCE TO RELATED APPLICATION(S)

This application is a continuation of U.S. application Ser. No. 13/965,703 filed Aug. 13, 2013, which is incorporated herein by reference, in its entirety, for any purpose.

BACKGROUND OF THE INVENTION

Helmets are used in many outdoor activities to protect the wearer from head injuries that may occur during the activity. For example, helmets worn during cycling sports protect the rider's head in the event of a fall or crash, as well as from equipment (e.g., bike) that may strike the wearer in the head.

Consumers measure the desirability of a helmet based on various criteria. For example, helmets should provide good protection to the head in the event of an impact, but should also be relatively light in weight and provide sufficient ventilation when worn. Helmets should also be affordable and have a design that facilitates manufacturability. Additionally, a helmet should be esthetically pleasing.

Often, these various criteria compete with one another. For example, a helmet that is light in weight and provides adequate ventilation is generally less impact resistant than one that has a heavier design. That is, a helmet can be designed with a harder shell material that is generally heavier than other lighter shell materials resulting in a helmet that provides greater protection but is not as light as desirable. A helmet may be designed to have less ventilation cavities to improve coverage of the head in the event of an impact, but this results in a helmet having less ventilation than is desirable. Additionally, a helmet providing good head protection and is light in weight may be complicated to manufacture and can be expensive.

Therefore, there is a need for alternative helmet designs that can balance various competing factors that are used in measuring the desirability of a helmet.

DETAILED DESCRIPTION

The present invention is generally directed to a helmet formed having a shell, a shock absorbing liner formed from a first shock absorbing material (e.g., expanded polystyrene (EPS) material, expanded polypropylene (EPP) material, or another suitable shock absorbing material). The shock absorbing liner includes one or more cavities (e.g., openings, recesses, etc.) having a shape to receive a shock absorbing insert formed from a second shock absorbing material (e.g., a honeycomb material). The shape of the insert relative to a shape of a cavity (or cavity) in the first shock absorbing material is such that the insert must be deformed (e.g., compressed) in order to be removed from the cavity in the first shock absorbing material. Many of the specific details of certain embodiments of the invention are presented in the following description and in FIGS. 1-6A-D to provide a thorough understanding of such embodiments. One skilled in the art will understand, however, that the present invention may have additional embodiments, or that the present invention may be practiced without several of the details described in the following description.

Figure 1:
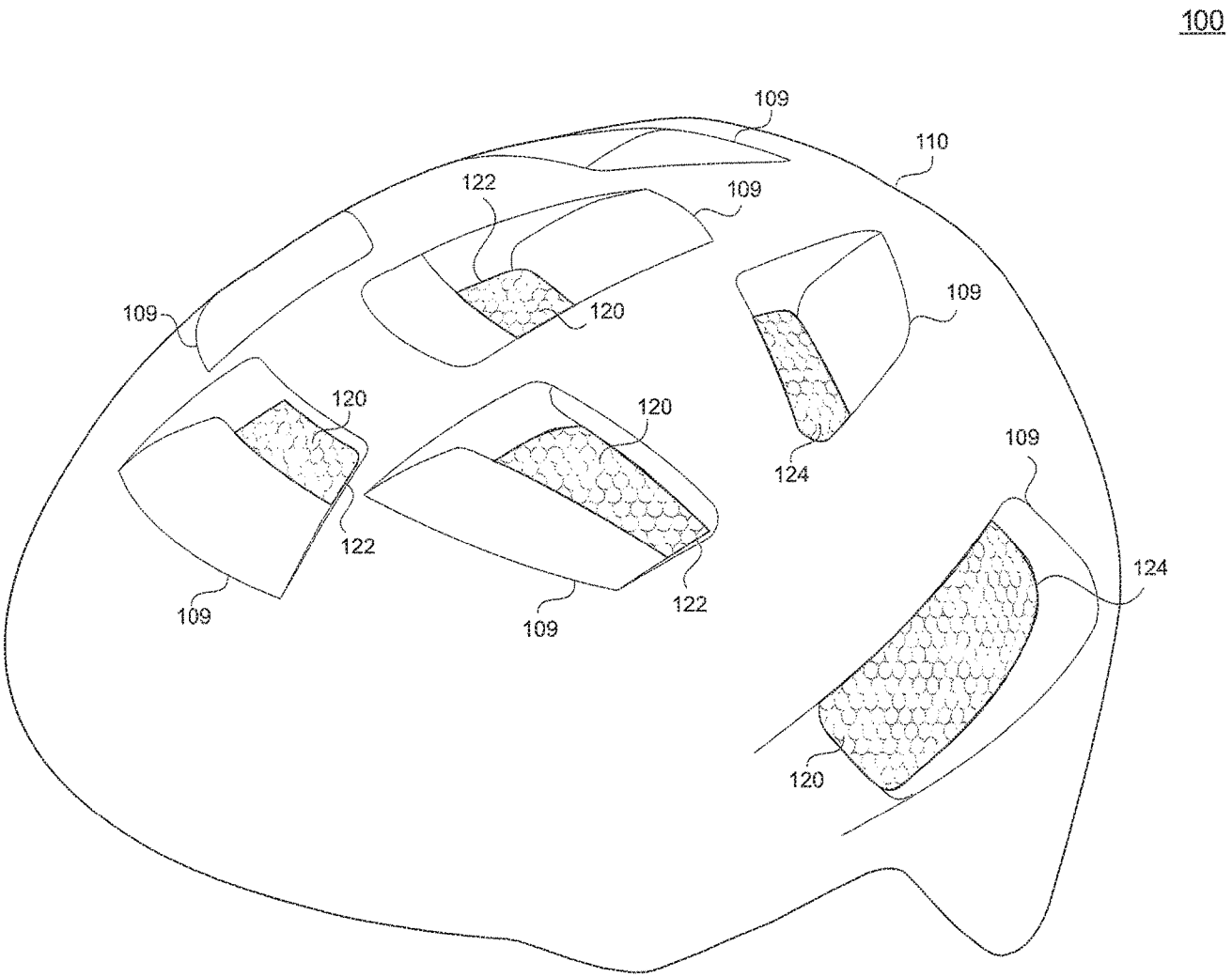
FIG. 1 is an isometric view of the front, top, and left side of a helmet according to an embodiment of the invention.

FIG. 1 illustrates a helmet 100 according to an embodiment of the invention. The helmet 100 includes a shell 110 having vents 109 to provide ventilation to the head of a wearer. Viewed from inside the helmet 100, the shell 110 generally forms a bowl shape. Visible through the vents 109 of the shell 110 are inserts 122 and 124 constructed of a second shock absorbing material 120. As will be described further, in some embodiments the second shock absorbing material 120 may be a honeycomb material. A honeycomb material may be used to provide impact absorption and have tubes with open longitudinal ends that allow air to freely flow through the tubes in the shell 110 to the head of the wearer. For example, the honeycomb material includes tubes arranged in a closely packed array. In some embodiments, a visor (not shown) may be optionally included with the helmet 100. The visor may be attached to a front of the shell 110, or alternatively, integrally formed with a front of the shell 110.

Figure 2:
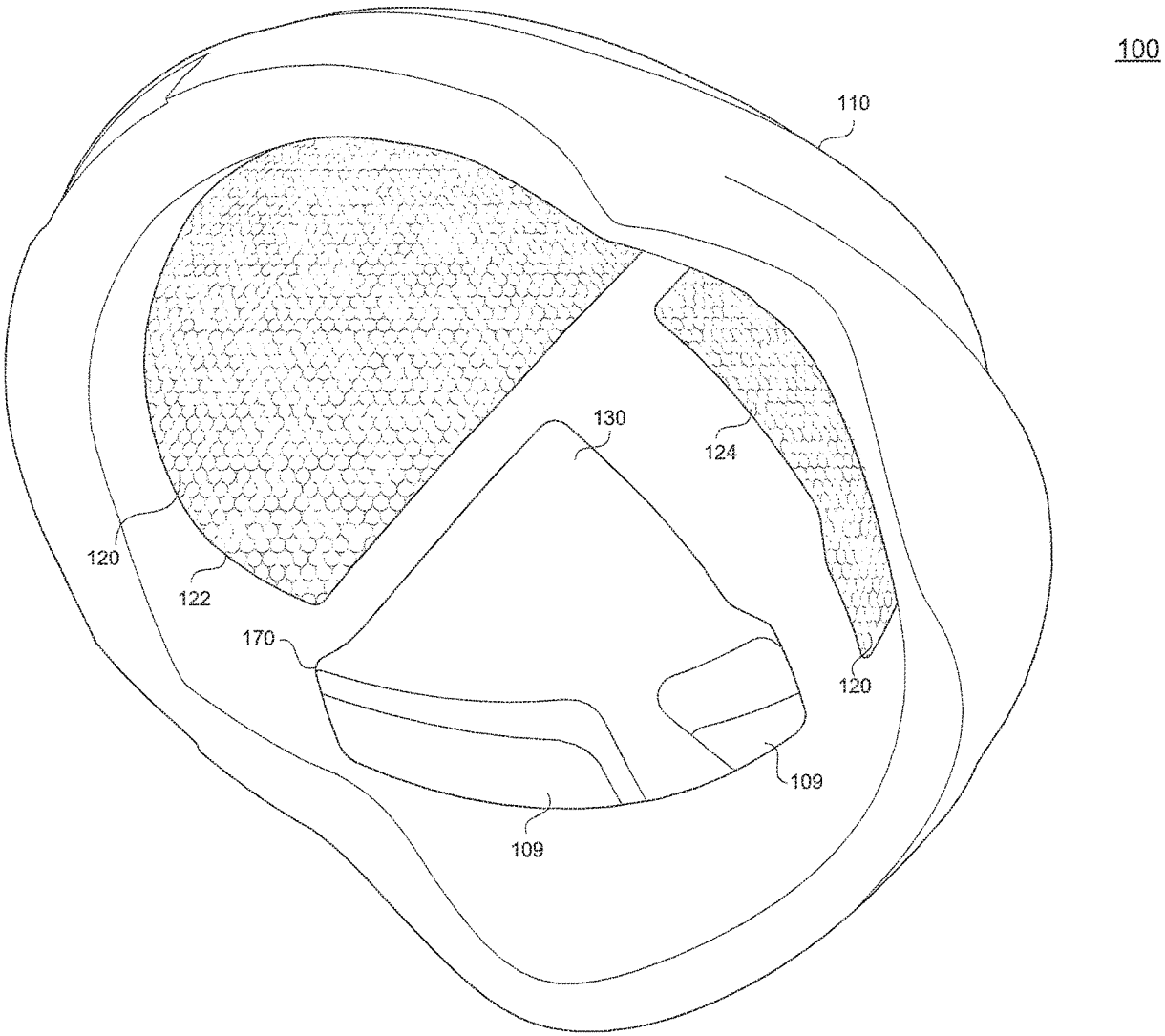
FIG. 2 is an isometric view of the left side and the inside of the helmet of FIG. 1 including shock absorbing inserts according to an embodiment of the invention.

FIG. 2 illustrates the helmet 100 depicted in FIG. 1 from another view. As explained above, the shell generally forms a bowl shape, and the shock absorbing liner 130 lines at least a portion of the interior of the shell 110. The shock absorbing liner 130 may include cavities into which inserts 122 and 124 are inserted. The cavities may be shaped to hold inserts 122 and 124 made of the second shock absorbing material 120. Note that an insert 126 is removed to show a cavity (e.g., an opening, a recess, etc.) 170 of the shock absorbing liner 130 in which the insert 126 may be inserted. Together, the shock absorbing liner 130 and the installed inserts 122, 124, and 126 generally form a bowl shape having a concave portion that is configured to receive a wearer's head.

Figure 3:
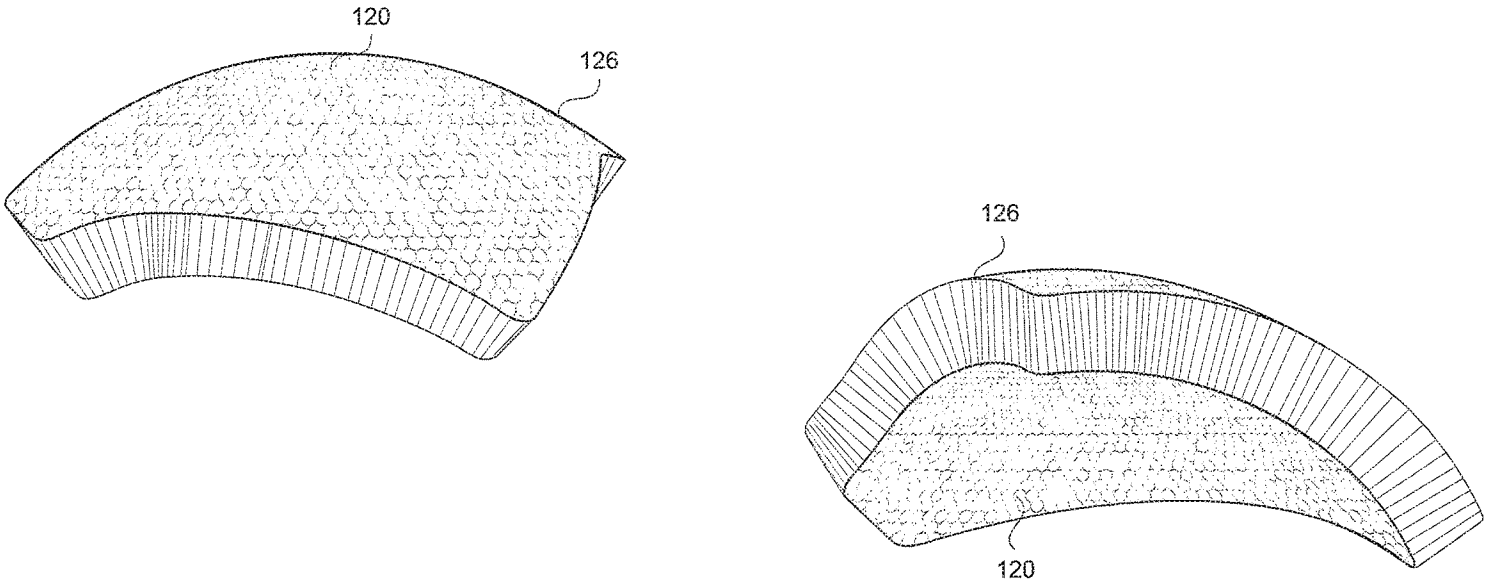
FIG. 3 includes isometric views of the shock absorbing inserts of FIG. 2.

FIG. 3 illustrates two views of an insert 126 according to an embodiment of the invention. The shock absorbing liner 126 may be placed in the cavity 170 of FIG. 2. As explained, the insert 126 may be constructed of a second shock absorbing material 120. In some embodiments, the second shock absorbing material 120 may be a porous shock absorbing material. For example, the second shock absorbing material 120 of the insert 126 may include a honeycomb material that includes an array of energy absorbing cells. In addition to providing impact absorption, each of the cells may include a tube, which may allow air to pass through, providing ventilation to the head of the wearer of the helmet 100 of FIG. 1 or FIG. 2. The insert 126 may have a shape relative to a shape of the cavity 170 of FIG. 2 where removing the insert 126 from the cavity 170 requires manually deforming (e.g., compressing) the insert 126. Examples of shapes of the insert 126 relative to a shape of the cavity 170 are described further with reference to FIGS. 6A-D. The tubes may be hollow structures having any regular or irregular geometry. The honeycomb structure of the insert 126 may provide improved shock absorbing protection as compared with the material of the shock absorbing liner 130, for example, EPS material or the EPP material, or other materials. It will be appreciated that inserts 122 and 124 of FIG. 2 may be formed from a similar material as the insert 126 of FIG. 3. Additionally, the inserts 122 and 124 may have a shape relative to a shape of each of their respective cavity in the shock absorbing liner 130 of FIG. 2 that requires compressing the inserts 122 and 124 to be removed from their respective cavity. For example, an insert may have a curved shape corresponding to a curved interior surface of a respective cavity in the shock absorbing liner in which the insert is inserted.

The shock absorbing liner 130 may be formed to have an inner surface that is configured to receive the wearer's head with one or more cavities, such as the cavity 170. The cavity 170 may extend all of the way through the shock absorbing liner 130. In some embodiments, one or more cavities may not extend all of the way through the shock absorbing liner 130. The shock absorbing liner 130 may be attached (e.g., bonded) to an inner surface of the shell 110. The shock absorbing liner 130 may be seamless, aside from the seam formed with the inserts 122, 124, and 126. For example, the shock absorbing liner 130 may not be interrupted by joints or seams that may compromise the shock absorbing capabilities and/or the structural integrity of the shock absorbing liner 130 during impact of the helmet 100. That is, forming the shock absorbing liner 130 to have an inner surface that is seamless may result in greater structural strength than an inner surface that includes seams between different portions of the shock absorbing liner 130. Although a seamed shock absorbing liner 130 may be less desirable than one having a seamless inner surface, such a construction is within the scope of the present invention.

FIG. 2 depicts the cavity 170 in the shock absorbing liner 130 without the insert 124 installed. The depth and shape of the cavity 170 may be based on, for example, a desired level of shock absorbing protection, the shock absorbing characteristics of the first and second shock absorbing materials, and the size of the inner concave portion for receiving a wearer's head. Generally, a shape of the inserts 122, 124, 126 relative to a shape of the respective cavity 170 is such that the insert 122, 124, or 126 is required to be manually deformed (e.g., compressed) in order to be removed from the cavity 170. The inserts 122, 124, and 126 may be retained in the respective cavity 170 based on an expansion pressure of the sides of the insert 122, 124, and 126 against the sides of the respective cavity 170. In other embodiments, the insert 122, 124, 126 may be keyed to the cavity 170 in such a way that prevents removal of the insert 122, 124, and 126 from the cavity 170 without manually deforming the insert 122, 124, and 126. Thus, the inserts 122, 124, and 126 may be retained in the cavity 170 without being bonded or using an adhesive material. In some embodiments, the insert 122, 124, and 126 may have a thickness less than or equal to a thickness of the shock absorbing liner 130.

The shell 110 may be formed from polycarbonate (PC), Acrylonitrile butadiene styrene (ABS). The shell 110 may be formed from materials suitable for use in an in-mold manufacturing process. The shock absorbing liner 130 may be formed from various materials, for example, EPS material, EPP material, or other suitable shock absorbing materials. In some embodiments, the shell 110 and shock absorbing liner 130 components may be formed using in-mold technology. For example, the shell 110 may be formed by injection molding techniques, or from a PC flat sheet which is first thermally formed and then installed in the final EPS mold to heat bond with the final form shape. As known, the shells may be insert molded. The shell 110 may be formed from other materials and/or using other manufacturing techniques as well. Thus the present invention is not limited to the particular materials previously described or made using an in-mold process.

As previously described, the second shock absorbing material 120 of the inserts 122, 124, and 126 may be a honeycomb material. The honeycomb material may have tubes that allow air to freely flow through to the head of the wearer. The honeycomb material may include an array of energy absorbing cells. Each of the cells may include a tube. In an embodiment, the tubes may be oriented along a thickness of the insert. In some embodiments, a tube of the insert may be generally oriented along a longitudinal axis that is normal to an adjacent point on the inner surface of the shell 110. For example, the longitudinal axis of a tube of a cell may be arranged at an angle of between 0° and 450 to a line normal to the adjacent point on the inner surface of the outer shell 110. The tubes may be a hollow structure having any regular or irregular geometry. In some embodiments, the tubes have a circular cylindrical structure or circular conical structure. As depicted in FIG. 1, at least a portion of one or more of the inserts 122, 124, and 126 may align with a vent 109 in the shell 110 to provide ventilation. Thus, a vent 109 of the shell 110 overlaps (e.g., aligns) with a portion of the cavity 170 of the shock absorbing liner 130. The vent 109 aligned with the insert 122, 124, or 126 is configured to allow air to flow through the vent 109 and the insert 122, 124, and 126 to the head of a wearer.

Helmet straps (not shown) may be attached to the shell 110 and/or the shock absorbing liner 130, and used to secure the helmet to a wearer's head. In some embodiments, the helmet straps are attached to helmet strap loops, which may be attached to the shock absorbing liner 130, for example, by having a portion embedded in the shock absorbing liner 130. Other attachment techniques may be used as well, for example, adhesive or other bonding techniques.

It will be appreciated that while FIG. 2 depicts three inserts 122, 124, and 126 in the first shock absorbing material, it would be recognized that the helmet may include more or less than three inserts. Further, the total area of the inserts may cover more than 50% of the inner surface that receives the wearer's head, and, in some embodiments, more than 90%.

Figure 4:
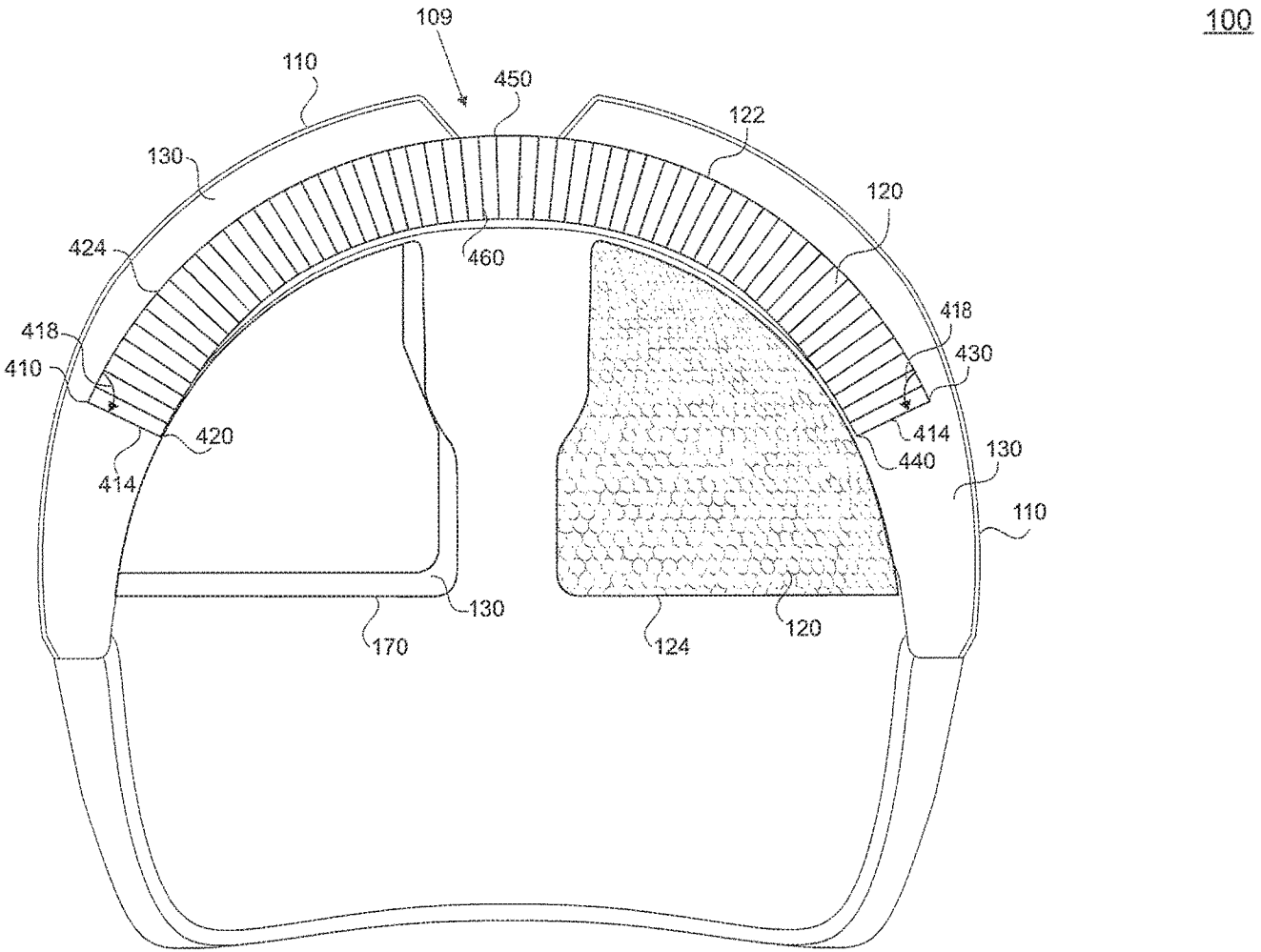
FIG. 4 is a left to right vertical cross-sectional view of the helmet of FIG. 1 including a cross-section of a front shock absorbing insert.

FIG. 4 illustrates a vertical cross section of the helmet 100 of FIG. 1, including a cross section the insert 122 having the second shock absorbing material 120. The insert 122 is shown inserted having the second shock absorbing material 120. The cavity 170 is shown without the insert 126 installed. As previously described, a shape of the inserts 122, 124, 126 relative to a shape of the respective cavity 170 is such that the inserts 122, 124, or 126 are required to be manually deformed in order to be removed from the respective cavity 170. The cavity in which the insert 122 is inserted is configured such that the distance along the curved side 450 between the sidewalls 414 of the cavity is greater than the distance along the curved side 460 between the sidewalls 414. Forming the cavity in the shock absorbing liner 130 in his manner causes the insert 122 to be retained in the cavity, and removal of the insert 122 may require deforming the insert 122. As a result of the cavity in the shock absorbing liner 130 being configured to cause a distance along the curved side 450 from point 410 to point 430 that is greater than a distance along the curved side 460 from point 420 to point 440, the insert 122 may be retained in the cavity without bonding or use of an adhesive material.

The insert 122 may be removed from the cavity, for example, by deforming the insert to cause the curved side 450 to fit through the opening between points 420 and 440. The cavity may be configured to have an interior angle 418 formed by sidewall 414 relative to an interior surface 424 of the cavity to provide a distance between sidewalls 414 along the curved side 450 to be longer than a distance between sidewalls 414 along the curved side 460. In some embodiments, the interior angle 418 is 90 degrees or less. In some embodiments, the interior angle 418 is acute. Other configurations of cavities may be used in the alternative, or in combination to retain the insert 122 in the respective cavity without bonding or use of adhesive material. Examples of other configurations of cavities will be described in more detail with reference to FIGS. 6A-D.

Figure 5:
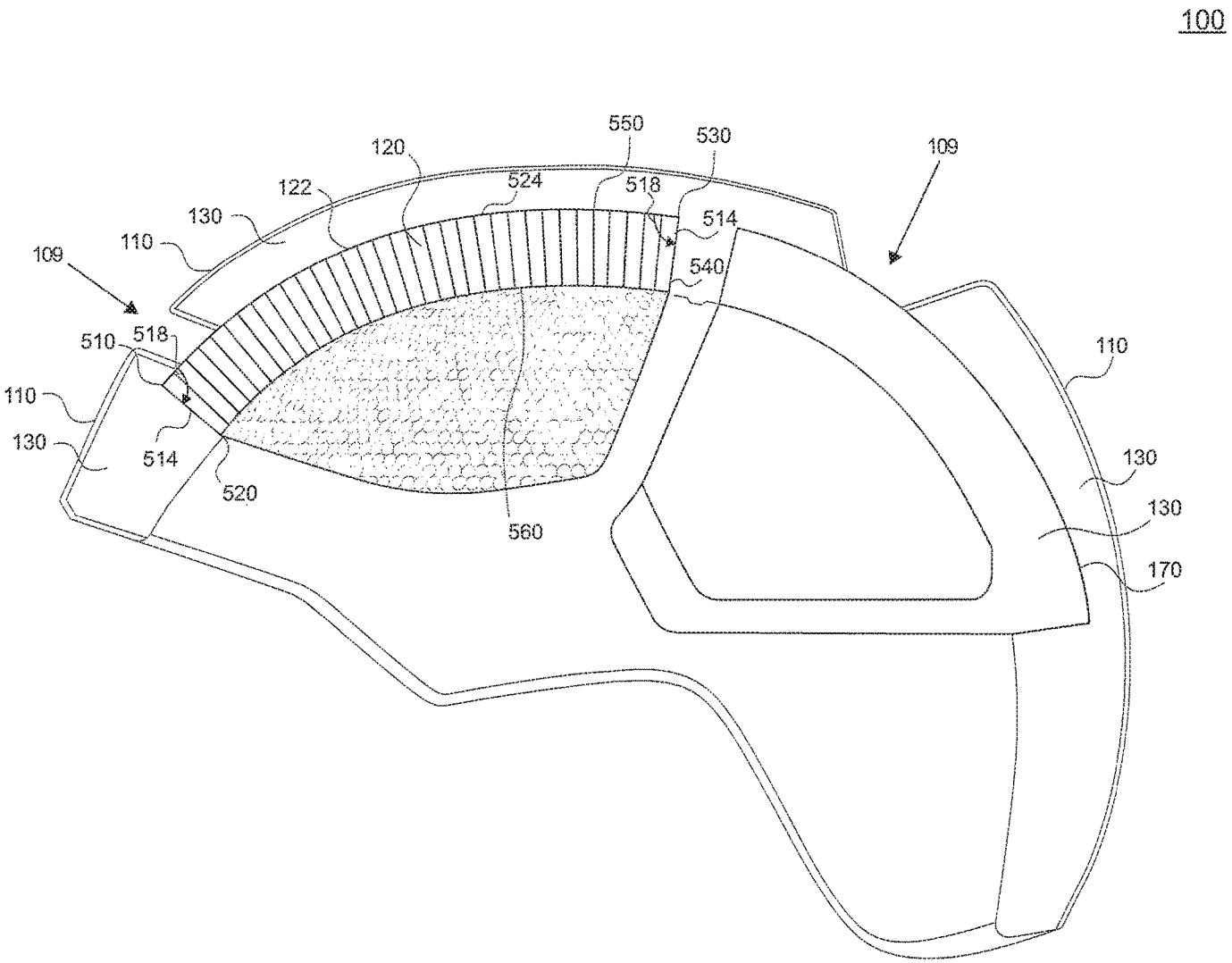
FIG. 5 is a front to back vertical cross-sectional view of the helmet of FIG. 1 including a cross-section of the front shock absorbing insert, and a cross-section of a cavity for a rear shock absorbing insert.

FIG. 5 illustrates a front to back vertical cross section of the helmet 100 of FIG. 1, including a cross section of the insert 122, and a cross section of the cavity 170 configured to receive the insert 126. Similar to the description with reference to FIG. 4, the cavity 170 may configured to have a front to back distance along the curved side 550 to be greater than the front to back distance along the curved side 560. The cavity may be further configured to have an interior angle 518 formed by sidewall 514 relative to an interior surface 524 of the cavity to provide a front to back distance along the curved side 550 to be greater than a front to back distance along the curved side 560. In some embodiments, the interior angle 518 is 90 degrees or less. In some embodiments, the interior angle 518 is acute. Thus, the insert 122 (and the corresponding cavity in the shock absorbing liner 130) having the distance across the curved side 550 from point 510 to point 530 that is greater than the corresponding distance across the curved side 560 from point 520 to point 540. The insert 122 may be removed from the cavity by deforming the insert 122 to cause the curved side 550 to fit through the opening between points 520 and 540. Other configurations for cavities will be described with reference to FIGS. 6A-D.

Figure 6A:
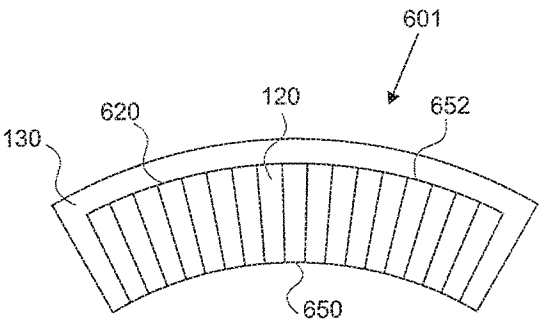
FIGS. 6A-D are cross sectional views of shock absorbing insert shapes according to various embodiments of the invention.
Figure 6B:
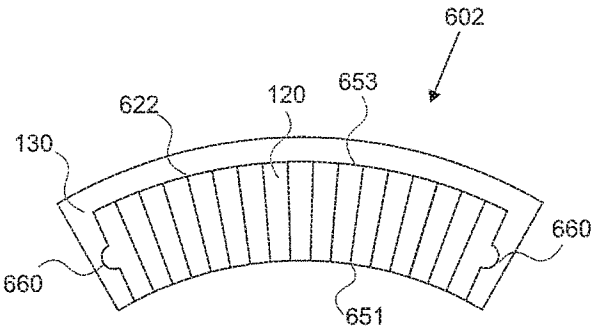
Figure 6C:
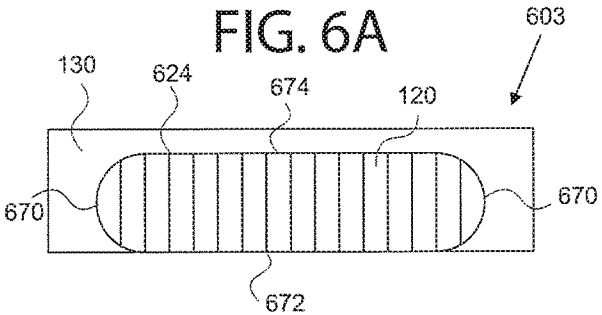
Figure 6D:
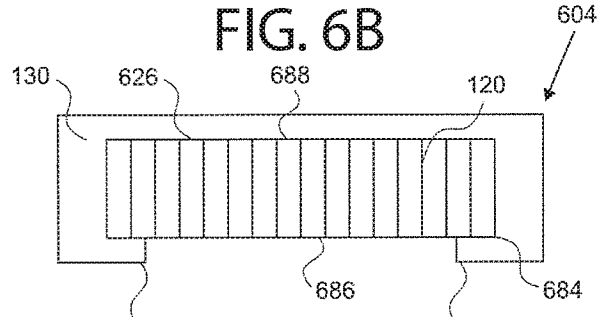

FIGS. 6A-D depicts embodiments of cross sections of cavities that are configured to retain a shock absorbing insert. FIG. 6A illustrates an embodiment including a curved shape with straight sidewalls 601. FIG. 6B illustrates an embodiment includes a curved shape with recesses in the sidewalls that receive a corresponding protrusion formed in the shock absorbing insert. FIG. 6C illustrates an embodiment including a flat rectangular shape with a semicircular recess at each sidewall that receives a corresponding semicircular portion formed in the shock absorbing insert. FIG. 6D illustrates an embodiment including a flat rectangular shape with straight sidewalls and a lip configured to retain the shock absorbing insert. The cavities and corresponding shock absorbing inserts of FIGS. 6A-6B may be used in addition, or in the alternative, to the cavities and correspondence shock absorbing inserts previously discussed.

The embodiment depicted in FIG. 6A is similar to the cross sections of insert 122 in FIGS. 4 and 5. The cavity in the first shock absorbing material 130 is such that the distance across the curved side 652 of the insert 620 is greater than the corresponding distance across the curved side 650 of the insert 620.

The embodiment 602 depicted in FIG. 6B includes protrusions (e.g., or keys) 660 around at least a portion of an edge (e.g., sidewall) of the insert 622 to retain the insert in the cavity of the first shock absorbing material 130. The protrusions 660 may be keyed to a recess in the shock absorbing liner 130. Thus, in order to remove the insert 622 from the cavity of the first shock absorbing material 130, the insert 622 may have to be compressed to release the protrusions 660 from the respective recesses in the shock absorbing liner 130. The protrusions 660 may have rounded or square corners. While the protrusions are located in the center of an edge of the insert 622, they may be placed off-center. Further, a size of the protrusions 660 may protrude further out from the edge of the insert 622 than depicted, and the recesses may be deeper into the shock absorbing liner 130 than depicted. Additionally, it will be recognized that the insert 622 may include more than one protrusion on each edge. The insert 622 may have similar curved side as those depicted in FIG. 6A, relative distance and angles of sides of the insert 622 may be the same as those described with reference to FIGS. 4, 5, and 6A. In other embodiments, the distance across the curved side 653 may be equal to or less than the corresponding distance across the curved side 651. In other embodiments, sides 651 and 653 may be straight and have equal distances.

The embodiment 603 depicted in FIG. 6C includes the insert 624 with rounded edges (e.g., sidewalls) 670 to retain the insert in the cavity of the first shock absorbing material 130. A recess may be formed in the shock absorbing liner 130 that matches a shape of the rounded edges 670. Thus, in order to remove the insert 624 from the cavity of the first shock absorbing material 130, the insert 624 may have to be compressed to release the rounded edges 670 from the respective recesses in the shock absorbing material 130. The rounded edges 670 may form a semicircular shape or a semi-ovular shape. The insert 624 may have straight sides, where a distance across of side 672 is equal to a corresponding distance across side 674. In other embodiments, the sides 672 and 674 may be curved as described with reference to FIGS. 6A and 6B, where the distance across side 674 is greater than the corresponding distance across side 672.

The embodiment 604 depicted in FIG. 6D includes tabs 680 formed in the first shock absorbing material (or affixed to the first shock absorbing material) that protrude laterally across the cavity and are configured to retain the insert 626 in the cavity of the first shock absorbing material 130. Thus, in order to remove the insert 626 from the cavity of the first shock absorbing material 130, the insert 624 may have to be compressed to bypass the tabs 680 from the respective from the cavity of the 130. Each of the tabs 680 may extend under the insert 626 by an equal amount. The insert 626 may have straight sides, where a distance across side 686 is equal to a corresponding distance across side 688. In other embodiments, the sides 686 and 688 may be curved as described with reference to FIGS. 6A and 6B, where the distance across side 688 is greater than the corresponding distance across side 686.

The above description of illustrated embodiments of the invention is not intended to be exhaustive or to limit the invention to the precise form disclosed. While specific embodiments of, and examples of, the invention are described in the foregoing for illustrative purposes, various equivalent modifications are possible within the scope of the invention, as those skilled in the relevant art will realize. Moreover, the various embodiments described above can be combined to provide further embodiments. Accordingly, the invention is not limited by the disclosure, but instead the scope of the invention is to be determined entirely by the following claims.

What is claimed is:

1. A helmet, comprising:

a shell;

a shock absorbing liner attached to the shell having a liner bottom surface;

a cavity formed in the shock absorbing liner; and a shock absorbing insert provided in the cavity having an insert bottom surface, wherein the liner bottom surface and the insert bottom surface are adjacently arranged, the shock absorbing insert having a thickness equal to or less than a depth of the cavity of the shock absorbing liner, and the shock absorbing insert is porous and formed of a material different than a material of the shock absorbing liner, wherein the cavity is configured to retain the shock absorbing insert, and wherein the shock absorbing insert comprises a honeycomb structure configured to provide an improved shock absorbing protection as compared with the material of the shock absorbing liner.

2. The helmet of claim 1, wherein the material of the shock absorbing liner is expanded polystyrene material or expanded polypropylene material.

3. The helmet of claim 1, wherein the material of the shock absorbing liner and the material of the shock absorbing insert together define an interior side of the helmet configured to receive the head of a wearer, wherein the material of the shock absorbing insert defines a larger portion of the interior side of the helmet than the material of the shock absorbing liner at a cross-section of the helmet.

4. The helmet of claim 1, wherein the shock absorbing insert has a first side and a second opposite side, the first side being closer to the shell than the second side, and wherein a portion of the shock absorbing liner extends over the second side of the shock absorbing insert to retain the shock absorbing insert in the cavity.

5. The helmet of claim 4, wherein the shock absorbing liner comprises tabs protruding radially inward from lateral sides of the cavity to retain the shock absorbing insert in the cavity.

6. The helmet of claim 4, wherein opposite lateral sides of the shock absorbing liner are curved.

7. The helmet of claim 1, wherein the shock absorbing insert extends to a portion of the helmet configured to be positioned at a back of a wearer's head.

8. The helmet of claim 1, wherein the helmet comprises a plurality of cavities and a plurality of shock absorbing inserts, each shock absorbing insert is arranged in a corresponding cavity.

9. The helmet of claim 1, wherein the shell comprises at least one vent and wherein the at least one vent is at least partially aligned with the cavity such that air is allowed to flow through the vent and through the honeycomb structure in the cavity toward an interior of the helmet.

10. The helmet of claim 1, wherein the shell comprises a first vent and wherein the cavity is a first cavity at least partially aligned with the first vent such that air is allowed to flow through the first vent and through the honeycomb structure in the cavity toward an interior of the helmet, and wherein the shell further comprises:

a second vent spaced apart from the first vent;

a second cavity formed in the liner to align at least partially with the second vent; and a second shock absorbing insert comprising the honeycomb structure provided in the second vent whereby air is allowed to flow through the second vent and through the honeycomb structure of the second shock absorbing insert in the second cavity toward the interior of the helmet.

11. The helmet of claim 10, wherein the second vent is located on an opposite side of a centerline of the shell from the first vent.

12. The helmet of claim 1, wherein a thickness of the shock absorbing insert is equal to or less than a thickness of the shock absorbing liner.

13. A helmet comprising:

a shell;

a shock absorbing liner attached to the shell;

a cavity formed in the shock absorbing liner; and a shock absorbing insert provided in the cavity, wherein the shock absorbing insert is porous and formed of a material different than a material of the shock absorbing liner, wherein the cavity is configured to retain the shock absorbing insert, wherein the shock absorbing insert comprises a honeycomb structure configured to provide an improved shock absorbing protection as compared with the material of the shock absorbing liner, and wherein the cavity is configured such that a distance along a first side of the shock absorbing insert near the shell is greater than a distance along a second side of the shock absorbing insert opposite the first side.

14. A helmet, comprising:

a shell comprising a vent;

a shock absorbing liner attached to the shell, the shock absorbing liner comprising a cavity; and a shock absorbing insert positioned in the cavity, wherein the cavity is configured to retain the shock absorbing insert, wherein the shock absorbing liner is made from a different material than the shock absorbing insert, the shock absorbing insert comprising a honeycomb structure comprising a packed array of tubes configured to allow air to flow through the tubes, and wherein the cavity and the shock absorbing insert in the cavity are at least partially aligned with the vent to enable air to flow through the vent and the tubes of the honeycomb structure in the cavity between an exterior and an interior of the helmet.

15. The helmet of claim 14, wherein a side of the shock absorbing liner near the interior of the helmet overlaps the shock absorbing insert to retain the shock absorbing insert in the cavity.

16. The helmet of claim 14, wherein the cavity is configured such that a distance along a side of the honeycomb structure near the shell is greater than a distance along a second side of the honeycomb structure opposite the first side.

17. The helmet of claim 14, wherein the shock absorbing liner and the shock absorbing insert together define an interior side of the helmet configured to receive a head of a wearer, wherein the honeycomb structure of the shock absorbing insert defines a larger portion of the interior side of the helmet than a material of the shock absorbing liner at a cross-section of the helmet.

18. A helmet, comprising:

a shell;

a shock absorbing liner adjacent to and attached to the shell;

a cavity formed in the shock absorbing liner; and a shock absorbing insert formed of a porous material different than a material of the shock absorbing liner, wherein the cavity is configured to retain the shock absorbing insert, and wherein the porous material of the shock absorbing insert is a porous honeycomb structure including an array of open-ended tubes configured to allow air to flow into the open-ended tubes in a direction normal to an inner surface of the shell and through from one side of the porous honeycomb structure to an opposite side of the porous honeycomb structure.

19. The helmet of claim 18, wherein the tubes are hollow structures having regular or irregular geometry.

20. The helmet of claim 18, wherein the shell comprises at least one vent and wherein the cavity is at least partially aligned with the vent such that air is allowed to flow through the vent and through the honeycomb structure in the cavity toward an interior of the helmet.

21. A helmet comprising: a shell having an inner surface; a shock absorbing liner adjacent to and attached to the shell; a cavity formed in the shock absorbing liner; and a shock absorbing insert formed of a porous material different than a material of the shock absorbing liner, wherein the cavity is configured to retain the shock absorbing insert, and wherein the porous material of the shock absorbing insert is a porous honeycomb structure having a plurality of tubes that allow air to flow through from one side of the porous honeycomb structure to an opposite side of the porous honeycomb structure, wherein the plurality of tubes include a longitudinal axis arranged at an angle between 0° and 45° to a line normal to a point adjacent to the respective tube on the inner surface of the shell.

* * * * *